US007325494B2

(12) United States Patent
Aoki

(10) Patent No.: US 7,325,494 B2
(45) Date of Patent: Feb. 5, 2008

(54) SHEET CONVEY APPARATUS FOR SHEET-FED OFFSET ROTARY PRINTING PRESS WITH CONVERTIBLE PRESS MECHANISM

(75) Inventor: Takanobu Aoki, Ibaraki (JP)

(73) Assignee: Komori Corporation, Tokyo (JP)

( * ) Notice: Subject to any disclaimer, the term of this patent is extended or adjusted under 35 U.S.C. 154(b) by 62 days.

(21) Appl. No.: 11/118,210

(22) Filed: Apr. 29, 2005

(65) Prior Publication Data

US 2005/0241510 A1 Nov. 3, 2005

(30) Foreign Application Priority Data

Apr. 30, 2004 (JP) ..... 2004-135213

(51) Int. Cl.
*B41F 21/10* (2006.01)

(52) U.S. Cl. ..... 101/230; 101/246; 101/409; 271/277

(58) Field of Classification Search ..... 101/409, 101/411, 232, 230, 231, 229, 246; 271/277, 271/275, 82

See application file for complete search history.

(56) References Cited

U.S. PATENT DOCUMENTS 4,466,350 A 8/1984 Schilling et al.
5,505,441 A 4/1996 Sugiyama et al.
6,283,467 B1 9/2001 Iida
6,536,340 B2 3/2003 Nakamura
2002/0000166 A1* 1/2002 Nakamura ..... 101/230

FOREIGN PATENT DOCUMENTS

DE 2045926 3/1972
DE 2314302 9/1974

* cited by examiner

*Primary Examiner*—Leslie J. Evanisko
(74) *Attorney, Agent, or Firm*—Blakely, Sokoloff, Taylor & Zafman

(57) ABSTRACT

A sheet convey apparatus for a sheet-fed offset rotary printing press with a convertible mechanism includes a gripper device and a gripper pad shaft. The gripper device swings between a first position to receive a sheet from a chucking cylinder on an upstream side in a sheet convey direction and a second position to transfer the sheet to a gripper device on a downstream side in the sheet convey direction. The gripper pad shaft extends in a widthwise direction of the sheet and pivots together with the gripper device. A position of a rotating shaft axis at an intermediate portion of the gripper pad shaft is set within a range of an angle which is formed by a line that connects rotating shaft axes at two ends of the gripper pad shaft and a sheet holding position of the gripper device at the first position and a line that connects the rotating shaft axes at the two ends of the gripper pad shaft and a sheet holding position of the gripper device at the second position.

19 Claims, 11 Drawing Sheets

SHEET CONVEY APPARATUS FOR SHEET-FED OFFSET ROTARY PRINTING PRESS WITH CONVERTIBLE PRESS MECHANISM

BACKGROUND OF THE INVENTION

The present invention relates to a sheet convey apparatus for a sheet-fed offset rotary printing press with a convertible press mechanism which prints on the obverse and reverse surfaces of a sheet by reversing the sheet by a convertible cylinder.

Generally, in a sheet convey apparatus of this type, the sheets chucked from a feed device to the suction port of a chucking device one by one are fed onto a feeder board as a feed roller rotates. The paper sheets on the feeder board are conveyed to a feedboard by a feed tape or the like, and the leading edges of the paper sheets fed onto the feedboard are jogged by a register. The paper sheets with the jogged leading edges are each gripped by the grippers of a swing arm shaft pregripper. When the swing arm shaft pregripper rotates, each paper sheet is conveyed to the cylinder of a printing press and transferred to the grippers of the cylinder. The paper sheet gripped by the grippers of the cylinder is printed while it passes through the contact point between an impression cylinder and blanket cylinder.

Moisture, high pressure, and the like which are supplied when the paper sheet is to be printed cause a phenomenon that the trailing edge of the paper sheet is stretched in the left and right. When this stretch occurs, the printing register, which is called fan-out register, of the non-gripped edge of the paper sheet is undesirably shifted during multicolor printing to cause a printing error.

In order to solve this problem, in the conventional sheet convey apparatus, when a paper sheet is to be transferred from the upstream side in the sheet convey direction, a gripper pad and gripper shaft are flexed in the sheet convey direction, as shown in U.S. Pat. Nos. 5,505,441 and 6,283,467. When the paper sheet is to be transferred to the downstream side in the sheet convey direction, the flex of the gripper pad and gripper shaft in the sheet convey direction is removed. Then, when the two ends of the paper sheet are pulled by grippers corresponding to the two ends of the paper sheet, the paper sheet can be transferred with its trailing edge being kept taut.

In the conventional sheet convey apparatuses described above, the paper sheet transferred from a sheet holding means on the upstream side in the sheet convey direction is transferred to a downstream sheet holding means without being reversed. Thus, this sheet convey apparatus cannot be applied to a convertible cylinder that reverses the obverse and reverse sides of the paper sheet by a pair of converting grippers provided to one cylinder. If the conventional sheet convey apparatus is to be applied to a sheet-fed offset rotary printing press with a convertible cylinder having a structure of this type, a fan-out register adjusting cylinder and convey cylinder must be arranged between the convertible cylinder and a cylinder located downstream of the convertible cylinder, and the entire length of the printing press increases accordingly. If a register adjusting mechanism is to be provided to the convertible cylinder, the structure of the convertible cylinder itself becomes complicated.

SUMMARY OF THE INVENTION

It is an object of the present invention to provide a sheet convey apparatus for a sheet-fed offset rotary printing press with a convertible mechanism which aims at improving the fan-out register accuracy.

In order to achieve the above object, according to the present invention, there is provided a sheet convey apparatus for a sheet-fed offset rotary printing press with a convertible mechanism, comprising sheet holding means for swinging between a first position to receive a sheet from a first sheet holding member on an upstream side in a sheet convey direction and a second position to transfer the sheet to a second sheet holding member on a downstream side in the sheet convey direction, and a pivotal shaft which extends in a widthwise direction of the sheet and pivots together with the sheet holding means, wherein a position of a rotating shaft axis at an intermediate portion of the pivotal shaft is set within a range of an angle which is formed by a line that connects rotating shaft axes at two ends of the pivotal shaft and a sheet holding position of the sheet holding means at a first position and a line that connects the rotating shaft axes at the two ends of the pivotal shaft and a sheet holding position of the sheet holding means at a second position.

DESCRIPTION OF THE PREFERRED EMBODIMENTS

The structure of a sheet-fed offset rotary printing press with a convertible mechanism according to the first embodiment of the present invention will be described with reference to FIGS. 1 to 4.

Figure 1:
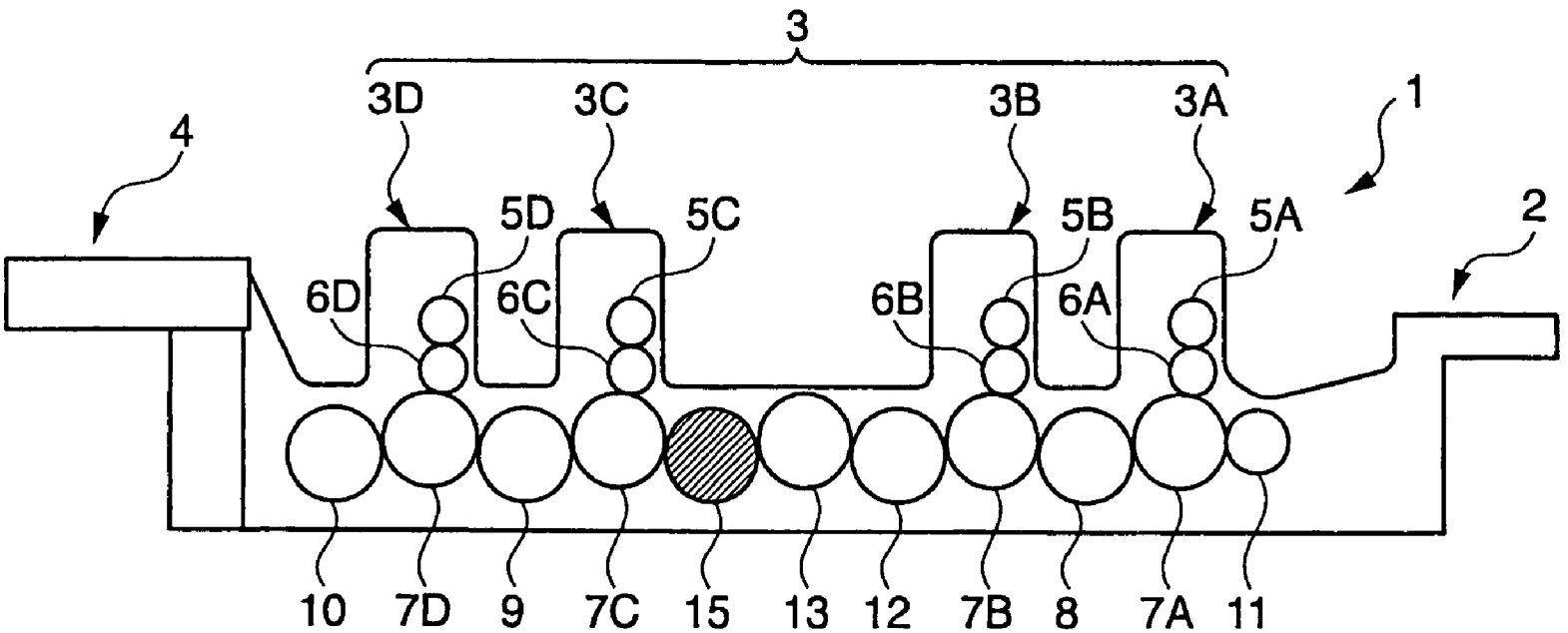
FIG. 1 is a schematic view showing the structure of a sheet-fed offset rotary printing press with a convertible mechanism to which the present invention is applied.

Referring to FIG. 1, a sheet-fed offset rotary four-color printing press 1 with a convertible mechanism includes a feed device 2, a printing device 3 having four-color printing units 3A to 3D, and a delivery device 4. The printing units 3A to 3D respectively have plate cylinders 5A to 5D, blanket cylinders 6A to 6D having outer surfaces in contact with the plate cylinders 5A to 5D, and impression cylinders 7A to 7D having outer surfaces in contact with the blanket cylinders 6A to 6D. Transfer cylinders 8, 9, and 10 are respectively interposed between the impression cylinders 7A and 7B, the impression cylinder 7C (third sheet holding member) and the impression cylinder 7D, and the impression cylinder 7D and a delivery cylinder (not shown).

A transfer cylinder 12, a chucking cylinder 13 (first sheet holding member), and a convertible cylinder 15 (hatched in FIG. 1 for the sake of convenience) having a convertible mechanism are interposed between the impression cylinder 7B of the second-color printing unit 3B and the impression cylinder 7C of the third-color printing unit 3C. A transfer cylinder 11 is arranged in contact with the impression cylinder 7A of the printing unit 3A. The transfer cylinder 11 adjusts the register of the obverse surface of a paper sheet as a sheet received from a swing arm shaft pregripper (not shown).

In the sheet-fed offset rotary four-color printing press 1 with the convertible mechanism, when the convertible mechanism of the convertible cylinder 15 is set in an inoperative state, one-side printing of printing four-color patterns is performed by the printing units 3A to 3D on the obverse surface of the paper sheet which is fed from the feed device 2. The printed paper sheet is delivered from the printing device 3 to the delivery device 4. When the convertible mechanism of the convertible cylinder 15 is set in an operative state, first, two-color patterns are printed on the obverse surface of the paper sheet by the printing units 3A and 3B. Subsequently, the obverse and reverse surfaces of the paper sheet are reversed by the convertible cylinder 15, and two-color patterns are printed on the reverse surface of the paper sheet by the printing units 3C and 3D. After double-side printing is performed on the two surfaces of the paper sheet in this manner, the paper sheet is delivered from the printing device 3 to the delivery device 4.

Figure 2A:
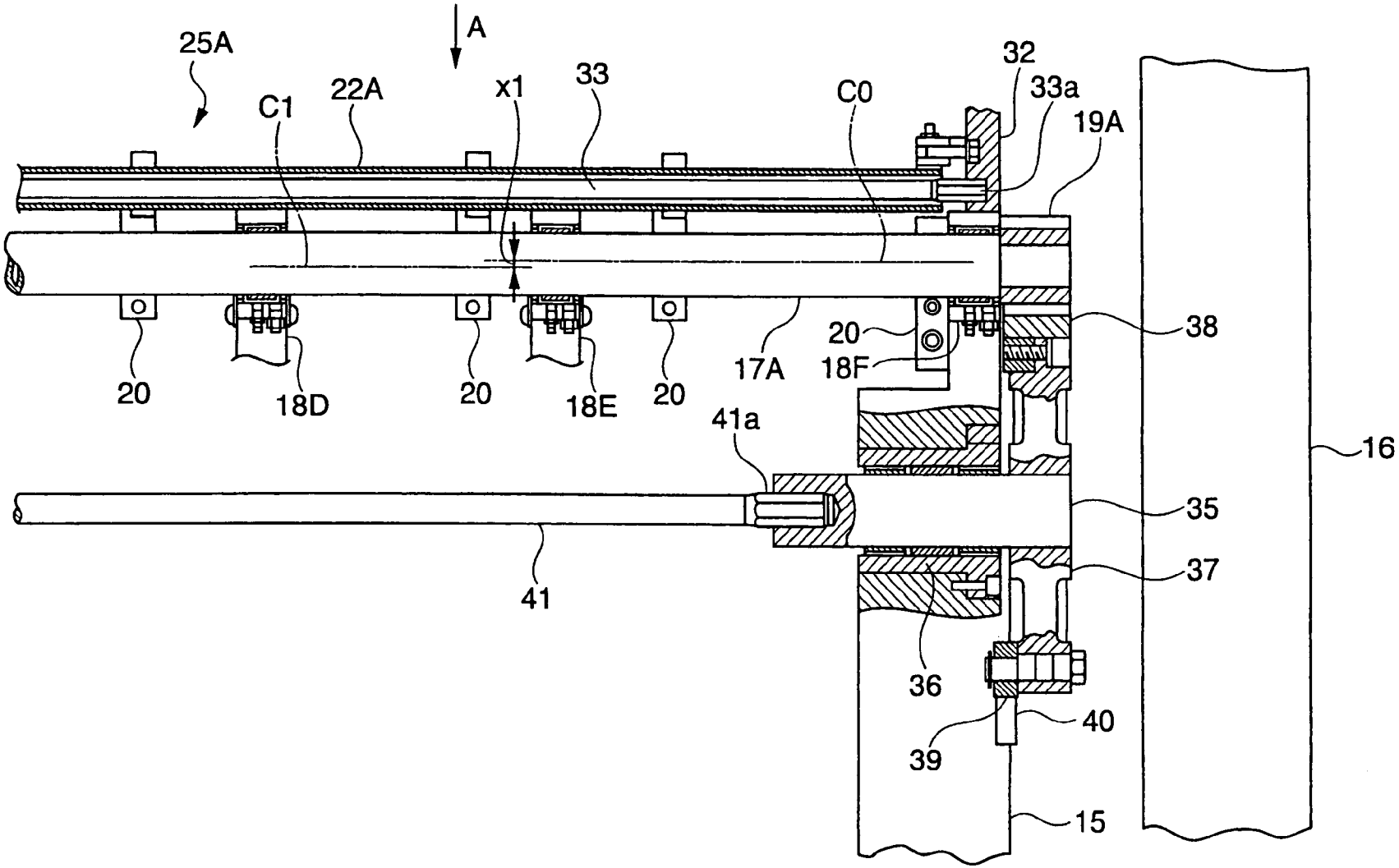
FIGS. 2A and 2B are developed plan views showing the right and left halves of a convertible cylinder according to the first embodiment of the present invention.
Figure 2B:
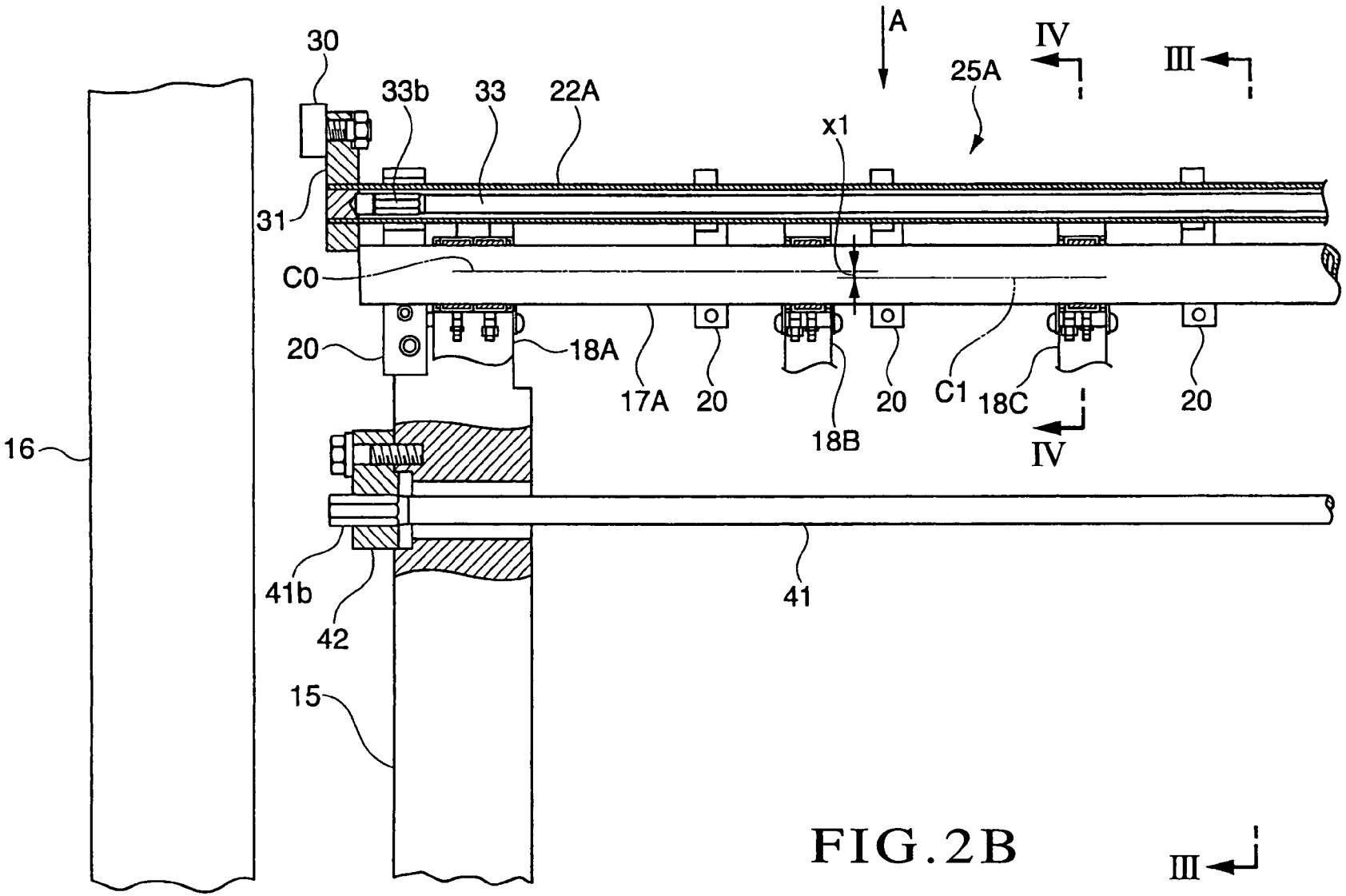

The convertible cylinder 15 will be described in detail with reference to FIGS. 2A to 4. Referring to FIGS. 2A and 2B, the end shafts (not shown) of a convertible cylinder 15 are rotatably supported between a pair of frames 16, which oppose each other at a predetermined gap, through bearings (not shown). Gripper pad shafts 17A and 17B (FIG. 3) serving as a pair of swing shafts are rotatably, axially supported by the convertible cylinder 15 throughout the entire length in the axial direction through six gripper pad shaft holders 18A to 18F serving as bearings.

Figure 4:
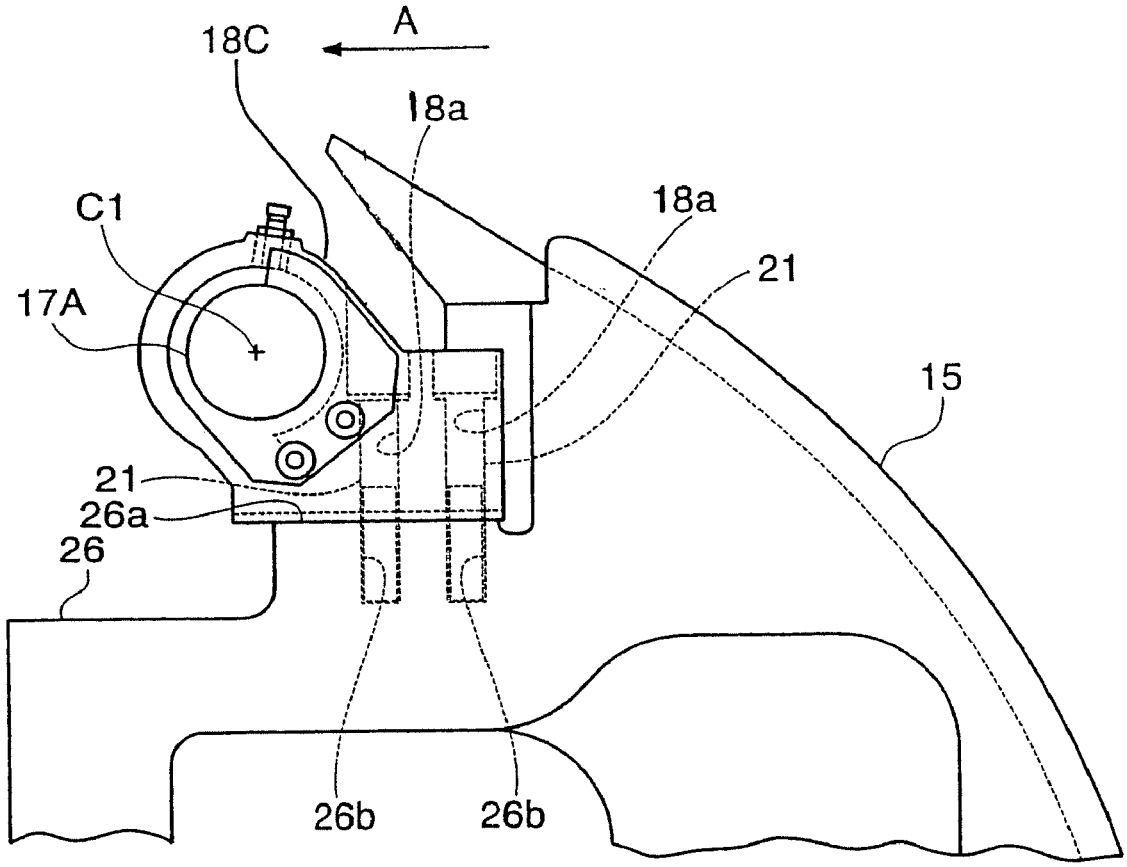
FIG. 4 is a sectional view taken along the line IV-IV of FIG. 2B.

The gripper pad shaft holders 18A to 18F have the same structure and will accordingly be described exemplifying the gripper pad shaft holder 18A in FIG. 4. A notch 26 is formed in the outer surface of the convertible cylinder 15 throughout the entire length of the cylinder main body in the axial direction. Along the axial direction of the convertible cylinder 15, six pairs of screw holes 26*b* are formed in a step 26*a* formed in the bottom of the notch 26. A pair of insertion holes 18*a* are formed in the gripper pad shaft holder 18A. The gripper pad shaft 17A is fixed to the step 26*a* in the notch 26 with bolts 21 which extend through the insertion holes 18*a* and threadably engage with the screw holes 26*b*. As described above, the gripper pad shaft 17A is rotatably supported by the six gripper pad shaft holders 18A to 18F which are fixed on the step 26*a*. Similarly, the gripper pad shaft 17B is also rotatably supported by six gripper pad shaft holders.

One end of the rotatably supported gripper pad shaft 17A projects from one end face of the convertible cylinder 15, and a pinion 19A is axially mounted on the projecting end. A plurality of gripper shaft holders 20 are attached to the gripper pad shaft 17A in the axial direction, and a hollow gripper shaft 22A is pivotally, axially supported by the gripper shaft holder 20 to be parallel to the gripper pad shaft 17A. Similarly, a pinion is axially mounted on one end of the gripper pad shaft 17B which projects from one end face of the convertible cylinder 15. A hollow gripper shaft 22B is pivotally, axially supported by a gripper shaft holder 20 attached to the gripper pad shaft 17B to be parallel to the gripper pad shaft 17B.

Figure 3:
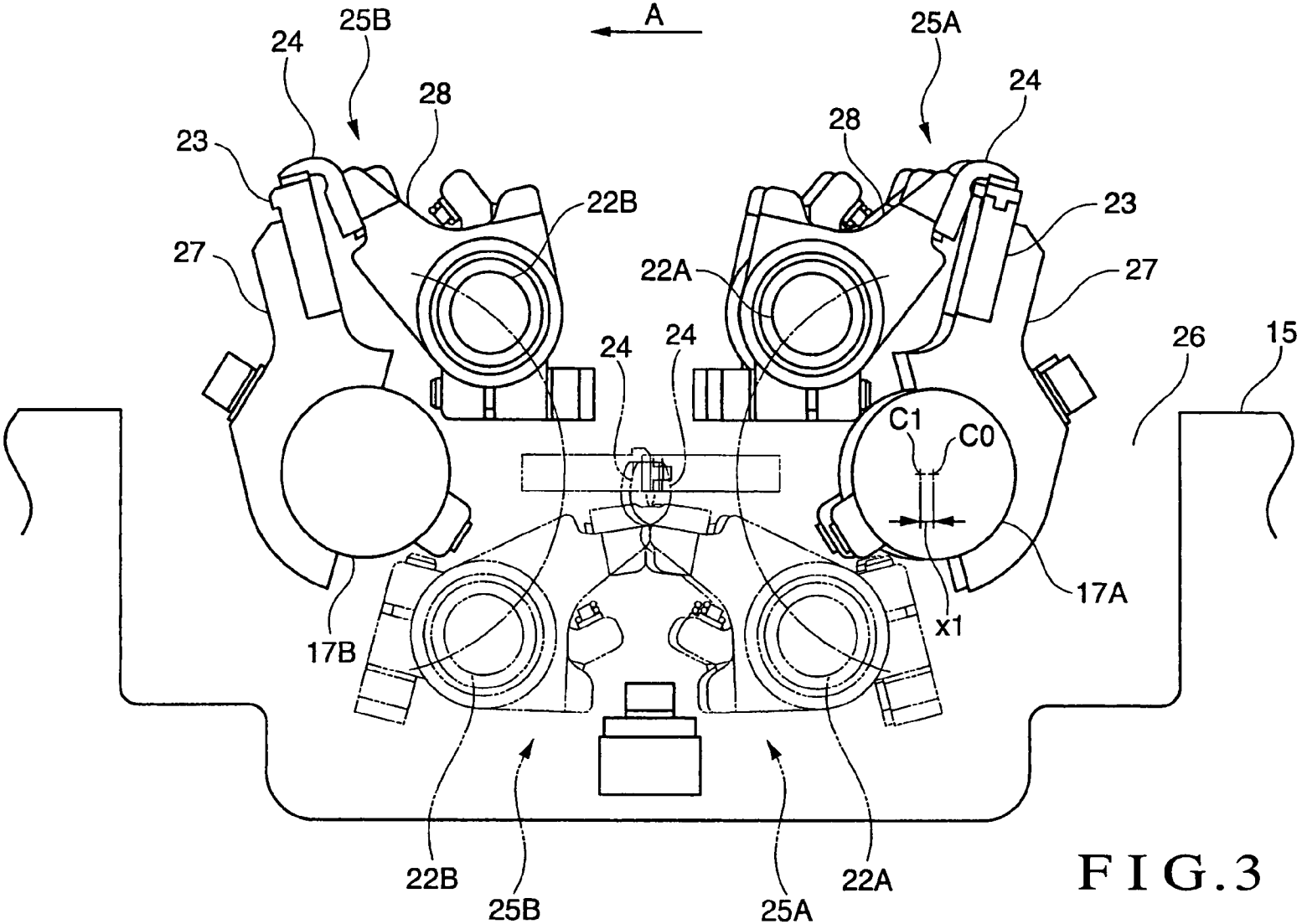
FIG. 3 is a sectional view taken along the line III-III of FIG. 2B.

As shown in FIG. 3, a plurality of gripper devices 25A (sheet holding means) each including a gripper pad 23 and grippers 24 line up in the axial direction on the gripper pad shaft 17A and gripper shaft 22A in the notch 26 of the convertible cylinder 15. As shown in FIG. 3, a plurality of gripper devices 25B (second sheet holding means) each including a gripper pad 23 and grippers 24 line up in the axial direction on the gripper pad shaft 17B and gripper shaft 22B in the notch 26 of the convertible cylinder 15. The gripper devices 25A and 25B are arranged alternately in the axial direction of the convertible cylinder 15.

The gripper devices 25A and 25B respectively have gripper pad holders 27 which are fixed to the gripper pad shafts 17A and 17B, and gripper holders 28 which are combined to have the same phase as the gripper pad holders 27 in the axial direction and split-fastened to the gripper shafts 22A and 22B. Each gripper pad 23 is fixed to the corresponding gripper pad holder 27, and the grippers 24 which open or close with respect to the gripper pad 23 upon pivotal motion of the gripper holder 28 are mounted on the gripper holder 28. The gripper pad holders 27 respectively pivot together with the gripper pad shafts 17A and 17B. The gripper holders 28 respectively pivot together with the gripper shafts 22A and 22B.

As shown in FIG. 2B, a cam lever 31, to which a cam follower 30 for opening/closing grippers is pivotally mounted, is axially mounted on one projecting end of each of the gripper shafts 22A and 22B which project from one end face of the convertible cylinder 15. As shown in FIG. 2A, a bar holder 32 is fixed to the other projecting end of each of the gripper shafts 22A and 22B which is not provided with a cam lever 31, such that the pivot motion of the bar holder 32 is adjustable. A torsion bar 33, a hexagon headed bolt 33*a* on one end of which is fitted in and fixed to a hexagonal hole in the bar holder 32, extends through a hollow inner hole in each of the gripper shafts 22A and 22B. A hexagon headed bolt 33*b* on the other end of the torsion bar 33 is fitted in a hexagonal hole formed in the other end of each of the gripper shafts 22A and 22B. When the cam lever 31 is pivoted by an external force, a torsion spring force is accumulated in the torsion bar 33.

The convertible mechanisms which convert the gripper devices 25A and 25B about the gripper pad shafts 17A and 17B as the centers will be described. The convertible mechanisms which convert the gripper devices 25A and 25B substantially have the same structure. Accordingly, a mechanism which converts the gripper devices 25A will be described in detail, and the gripper devices 25B will be described when necessary.

Referring to FIG. 2A, a cam lever shaft 35 is rotatably, axially supported at one end of the convertible cylinder 15 through a bearing 36. The central portion of a cam lever 37 is axially mounted on that end of the cam lever shaft 35 which projects from the end face of the convertible cylinder 15. A segment gear 38 which meshes with the pinion 19A axially mounted on the gripper pad shaft 17A is fixed to one end of the cam lever 37. A converting cam follower 39 which is to be in contact with a convertible cam 40 fixed to the convertible cylinder 15 is pivotally mounted on the other end of the cam lever 37. A hexagon headed bolt 41*a* at one end of a torsion bar 41 is fitted in and fixed to a hexagonal hole in the cam lever shaft 35. A hexagon headed bolt 41*b* at the other end of the torsion bar 41 is fitted in and fixed to a hexagonal hole in a fixing element 42 which is fixed to one end face of the convertible cylinder 15, so that the torsion spring force is accumulated in a direction to bring the converting cam follower 39 into contact with the convertible cam 40.

In this structure, when the converting cam follower 39 comes into contact with the large-diameter portion of the convertible cam 40, the cam lever 37 pivots about the cam lever shaft 35 as the center, and the pinion 19A meshing with the segment gear 38 also pivots. Thus, the gripper pad shaft 17A also pivots clockwise in FIG. 3 together with the pinion 19A, and the gripper devices 25A rise up in the notch 26, as indicated by a solid line. The position of the gripper devices 25A where they rise will be referred to as the first position of the gripper devices 25A hereinafter.

When the converting cam follower 39 comes into contact with the small-diameter portion of the gripper device convertible cam 40, the cam lever 37 pivots in the opposite direction about the cam lever shaft 35 as the center, and the pinion 19A meshing with the segment gear 38 pivots in the opposite direction. Thus, the gripper pad shaft 17A also pivots in the opposite direction together with the pinion 19A, and the gripper devices 25A lie down in the notch 26, as indicated by an alternate long and two short dashed line in FIG. 3. The position of the gripper devices 25A where they are lying will be referred to as the second position of the gripper devices 25A hereinafter.

Similarly, when the converting cam follower (not shown) of the gripper pad shaft 17B comes into contact with the large-diameter portion (not shown) of a gripper device convertible cam, the gripper devices 25B rise up from the notch 26, as indicated by a solid line in FIG. 3. The position of the gripper devices 25B where they rise will be referred to as the second position of the gripper devices 25B hereinafter. When the converting cam follower (not shown) of the gripper pad shaft 17B comes into contact with the small-diameter portion (not shown) of the gripper device convertible cam, the gripper devices 25B lie down in the notch 26, as indicated by an alternate long and two short dashed line in FIG. 3. The position of the gripper devices 25B where they are lying will be referred to as the first position of the gripper devices 25B hereinafter.

In double-side printing, the paper sheet is transferred when the gripper devices 25A and 25B lie in synchronism with each other (when the gripper devices 25A are at the second position and the gripper devices 25B are at the first position).

In this structure, during single-side printing, the converting operation of the gripper devices 25A and 25B is set in an inoperative state. When the gripper devices 25B in the upright state (second position) open and close, they grip the leading edge of the paper sheet which is conveyed by the impression cylinder 7B of the second-color printing unit 3B. When the gripper devices 25B oppose the gripper devices of the impression cylinder 7C of the third-color printing unit 3C, the gripper devices 25B open and close to transfer the paper sheet. At this time, the gripper devices 25A retreat as they are in the lying state (second position).

During double-side printing, the gripper devices 25A open and close in the upright state (first position), to grip the trailing edge of the paper sheet which is conveyed by the impression cylinder 7B of the second-color printing unit 3B. Then, the gripper devices 25A lie down (second position), and the gripper devices 25B also lie down (first position). In this state, the gripper devices 25A and 25B open and close to transfer the paper sheet from the gripper devices 25A to the gripper devices 25B, thus reversing the paper sheet. Then, when the gripper devices 25B which grip the paper sheet rise up (second position) and oppose the gripper devices of the impression cylinder 7C of the third-color printing unit 3C, the gripper devices 25B open and close to transfer the paper sheet.

The gripper pad shaft 17A of the gripper devices 25A which receives the paper sheet from the upstream impression cylinder 7B will be described.

In the gripper pad shaft 17A, a rotating shaft axis C1 at the intermediate portion in the axial direction is eccentric with respect to rotating shaft axes C0 at the two ends in the axial direction. More specifically, of the six pairs of screw holes 26*b*, the screw holes 26*b* formed at the intermediate portion are slightly shifted in a direction of an arrow A (the sheet convey direction) with respect to the screw holes 26*b* formed at the two ends of the convertible cylinder 15. Hence, of the gripper pad shaft holders 18A to 18F attached on the step 26*a* of the notch 26, the gripper pad shaft holders 18B to 18E (displacing means) which support the intermediate portion of the gripper pad shaft 17A are attached to be displaced in the direction of the arrow A with respect to the gripper pad shaft holders 18A and 18F which rotatably support the two ends of the gripper pad shaft 17A. Although the eccentricity amount is exaggerated in FIG. 3 for the descriptive convenience, the actual eccentricity amount is desirably about 100 μm to 500 μm, although it may differ depending on the paper sheet size.

As shown in FIGS. 2A and 2B, the rotating shaft axis C1 at the intermediate portion in the axial direction of the gripper pad shaft 17A which is rotatably supported by the gripper pad shaft holders 18A to 18F is eccentric with respect to the rotating shaft axes C0 at the two ends in the axial direction by a length xl in the direction of the arrow A (the direction of the grippers of the gripper devices 25A at the second position). In this case, the rotating shaft axis C1 at the intermediate portion of the gripper pad shaft 17A is located within the range of an angle (about 90°) which is formed by a line that connects the rotating shaft axes C0 at the two ends of the gripper pad shaft 17A and the gripping positions (gripper points) of the gripper devices 25A at the first position and a line that connects the rotating shaft axes C0 at the two ends of the gripper pad shaft 17A and the gripping positions (gripper points) of the gripper devices 25A at the second position. In this manner, the plurality of the gripper pad shaft holders 18A to 18F which are provided to the straight gripper pad shaft 17A in the axial direction make eccentric the rotating shaft axis C1 at the intermediate portion in the axial direction. Thus, the positions of the rotating shaft axes C0 and C1 do not change when the gripper pad shaft 17A pivots, but stay always the same.

Figure 5A:
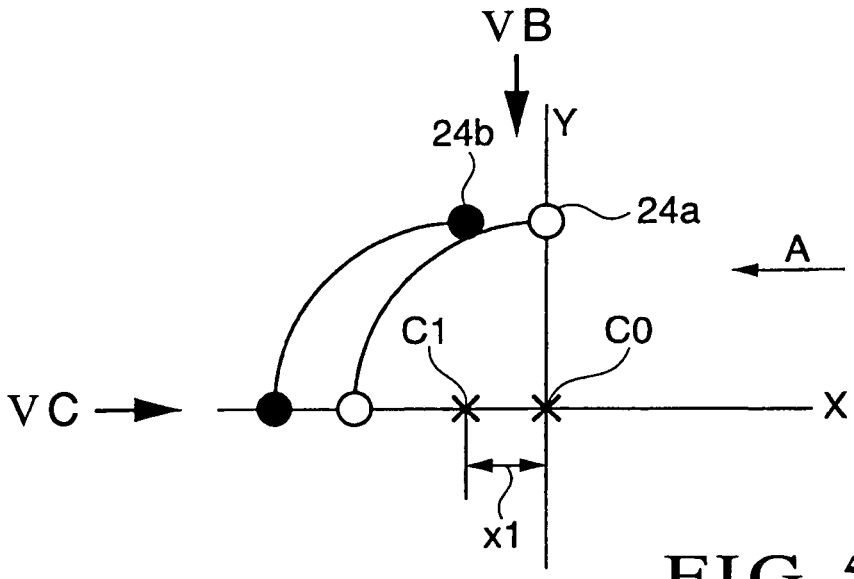
FIG. 5A is a view showing a state wherein the rotating shaft axis at the intermediate portion in the axial direction of a gripper pad shaft is eccentric with respect to the rotating shaft axes at the two ends of the gripper pad shaft in a direction of an arrow A (a sheet convey direction), and the trajectory from the first position (upright state) to the second position (lying state) of gripper members provided to the intermediate portion and two ends in the axial direction of the gripper pad shaft.
Figure 5B:
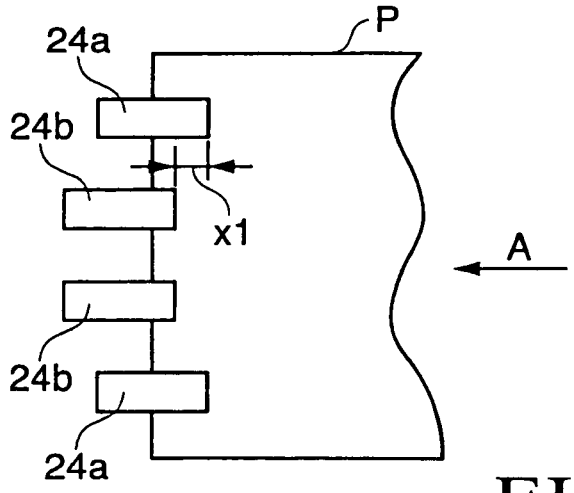
FIG. 5B is a view seen from the direction of an arrow VB of FIG. 5A to explain a grip amount by a sheet holding member at the first position.
Figure 5C:
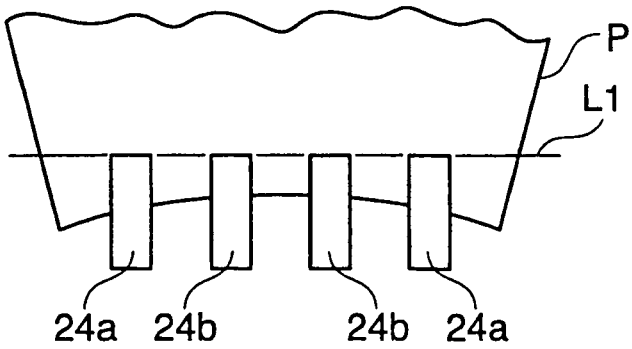
FIG. 5C is a view seen from the direction of an arrow VC of FIG. 5A to explain a state wherein the two ends of a sheet at the second position are pulled.

In this structure, while the gripper devices 25A are at the first position, of the grippers 24 of the gripper devices 25A that have gripped the trailing edge of a paper sheet P from the impression cylinder 7B of the second-color printing unit 3B during double-side printing, grippers 24*b* at the intermediate portion in the axial direction of the gripper pad shaft 17A grip the paper sheet with a gripping amount which is smaller by x1 than the gripping amount of grippers 24*a* at the two ends in the axial direction of the gripper pad shaft 17A. In this state, when the gripper devices 25A are converted from the first position and move to the second position, the distal ends of the grippers 24*a* at the two ends and the distal ends of the grippers 24*b* at the intermediate portion are aligned on one straight line L1, as shown in FIG. 5C. This is because the rotating shaft axis C1 at the intermediate portion in the axial direction of the gripper pad shaft 17A is not eccentric in the Y-axis direction with respect to the rotating shaft axes CO at the two ends in the axial direction of the gripper pad shaft 17A, as shown in FIG. 5A.

The pair of grippers 24*a* located at the two ends in the widthwise direction of the paper sheet P pull the two ends of the trailing edge of the paper sheet P in the widthwise direction of the paper sheet P. Thus, that edge (the leading edge) of the paper sheet P which is not gripped by the gripper devices 25A becomes taut. Even when the leading edge of the paper sheet P which is gripped by the gripper devices 25A is stretched in the widthwise direction of the paper sheet P, the leading edge of the paper sheet P becomes taut before the paper sheet P is transferred to the gripper devices 25B. As a result, the state wherein the leading edge of the paper sheet P is stretched in the widthwise direction of the paper sheet P is corrected. Therefore, the fan-out register accuracy can be improved.

The second embodiment of the present invention will be described with reference to FIGS. 6 and 7.

Figure 6:
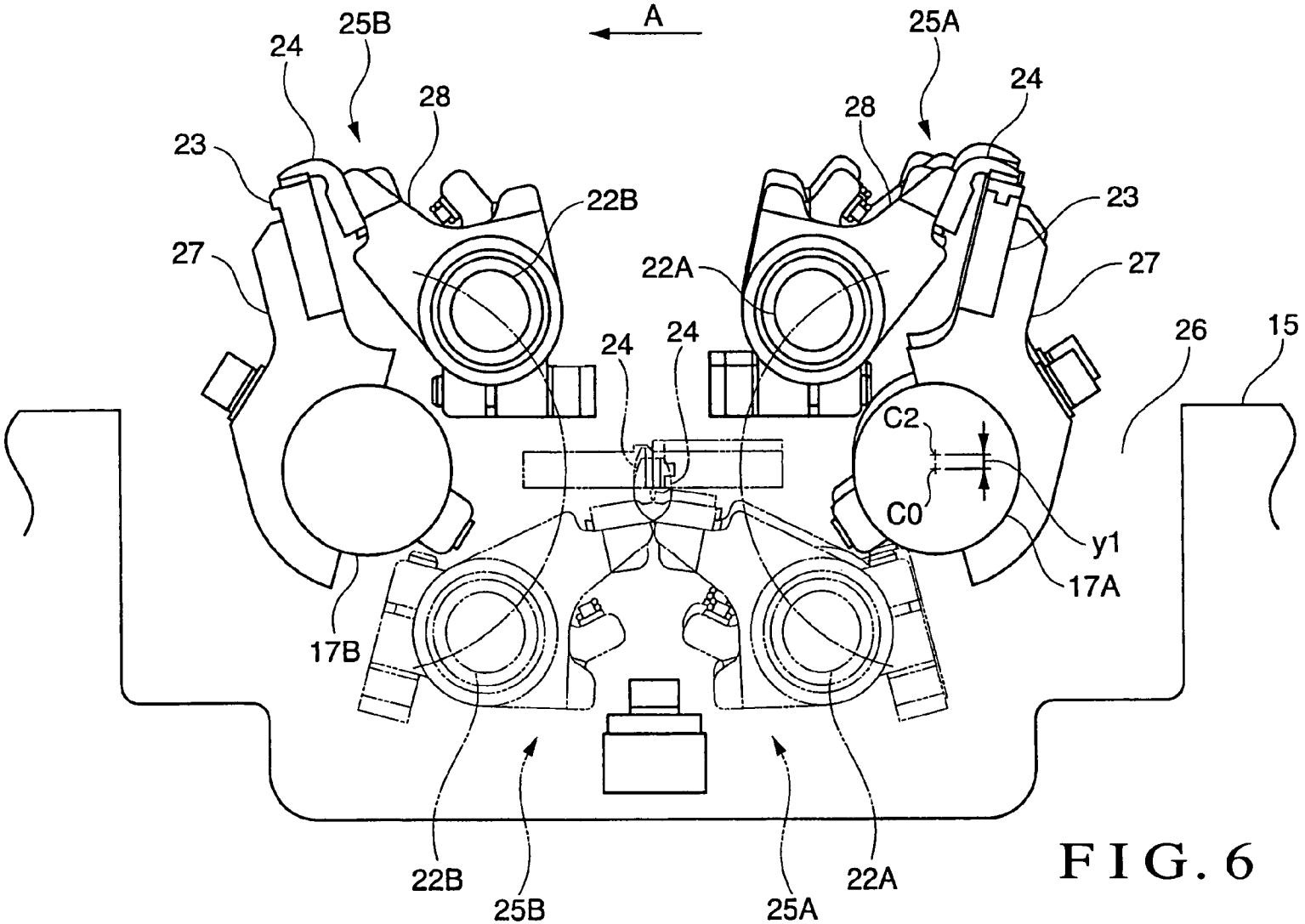
FIG. 6 is a sectional view taken along the line III-III of FIG. 2B to show the second embodiment of the present invention.
Figure 7:
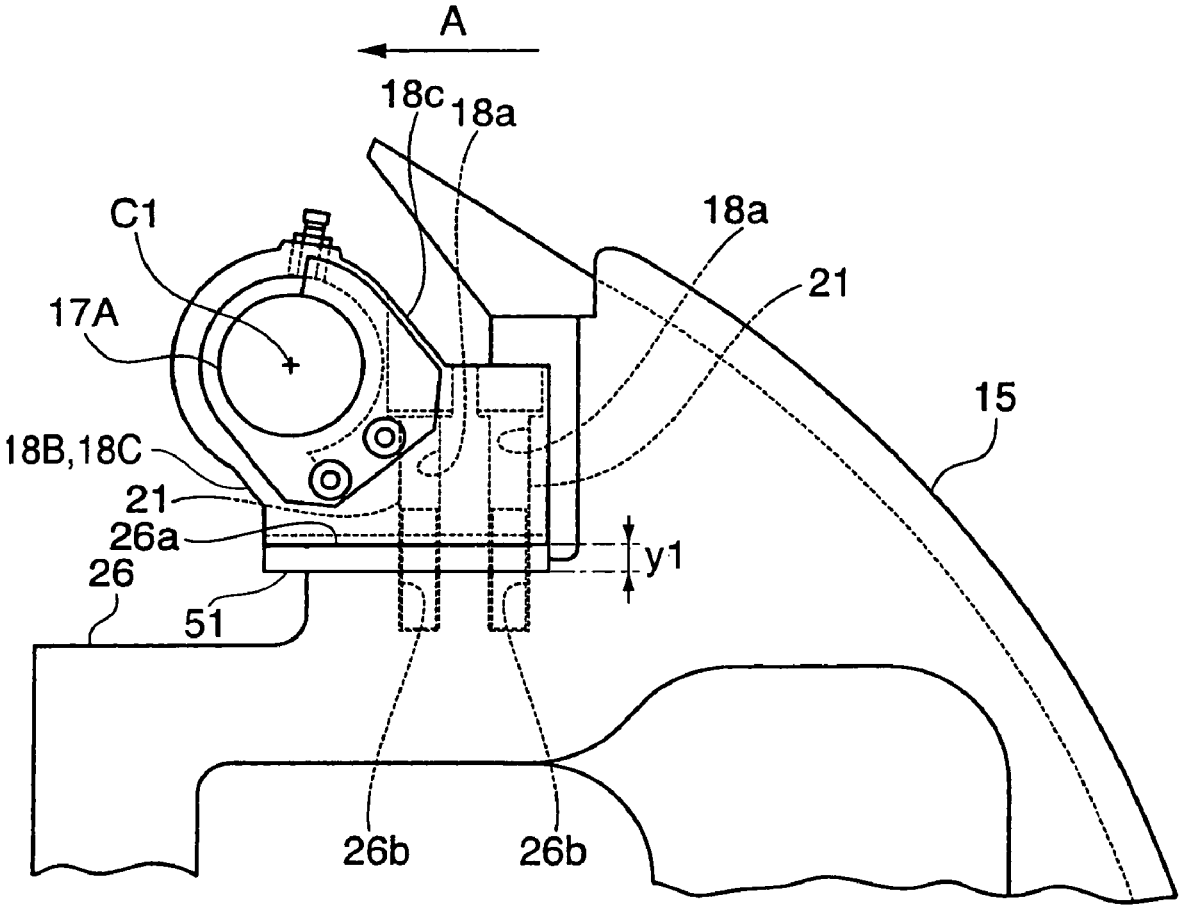
FIG. 7 is a sectional view taken along the line IV-IV of FIG. 2B to show the second embodiment of the present invention.
Figure 8A:
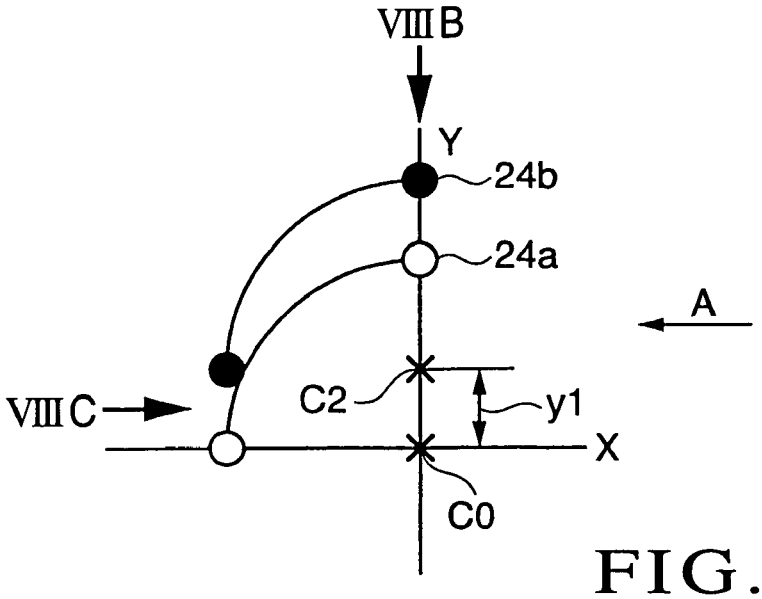
FIG. 8A is a view showing a state wherein the rotating shaft axis at the intermediate portion in the axial direction of the gripper pad shaft shown in FIGS. 6 and 7 is eccentric with respect to the rotating shaft axes at the two ends of the gripper pad shaft in a direction perpendicular to a direction of an arrow A (a sheet convey direction), and the trajectory from the first position (upright state) to the second position (lying state) of gripper members provided to the intermediate portion and two ends in the axial direction of the gripper pad shaft.

In the second embodiment, as shown in FIGS. 6 and 8A, a rotating shaft axis C2 at the intermediate portion in an axial direction of a gripper pad shaft 17A is eccentric with respect to rotating shaft axes C0 at the two ends in the axial direction of the gripper pad shaft 17A by a length y1 in a direction (the direction of grippers 24 of gripper devices 25A at the first position) perpendicular to a direction of an arrow A. As the eccentricity mechanism, as shown in FIG. 7, a spacer 51 having a thickness y1 is interposed between the upper surface of a step 26*a* of a notch 26 and the lower surfaces of gripper pad shaft holders 18C and 18D which are located at the intermediate portion in the axial direction of the gripper pad shaft 17A.

Then, gripper pad shaft holders 18B to 18E which support the intermediate portion of the gripper pad shaft 17A are attached to be displaced with respect to gripper pad shaft holders 18A and 18F which support the two ends of the gripper pad shaft 17A in a direction (the direction of the grippers of the gripper devices 25A at the first position) perpendicular to the direction of the arrow A. In this case, the rotating shaft axis C2 at the intermediate portion of the gripper pad shaft 17A is located within the range of an angle (about 90°) which is formed by a line that connects the rotating shaft axes C0 at the two ends of the gripper pad shaft 17A and the gripping positions (gripper points) of the gripper devices 25A at the first position and a line that connects the rotating shaft axes C0 at the two ends of the gripper pad shaft 17A and the gripping positions (gripper points) of the gripper devices 25A at the second position.

Figure 8B:
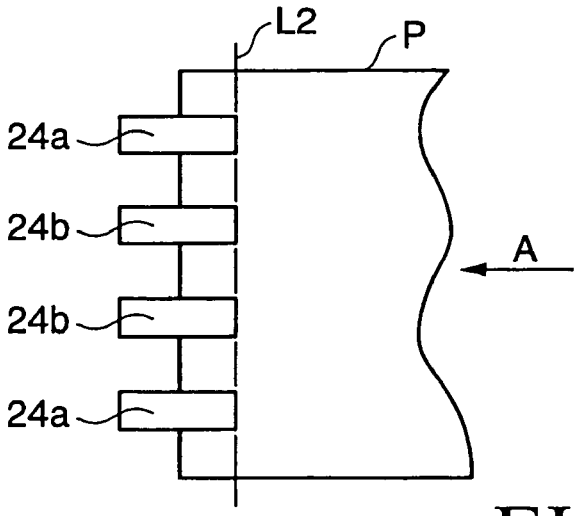
FIG. 8B is a view seen from the direction of an arrow VIIIB of FIG. 8A to explain a grip amount by a sheet holding member at the first position.
Figure 8C:
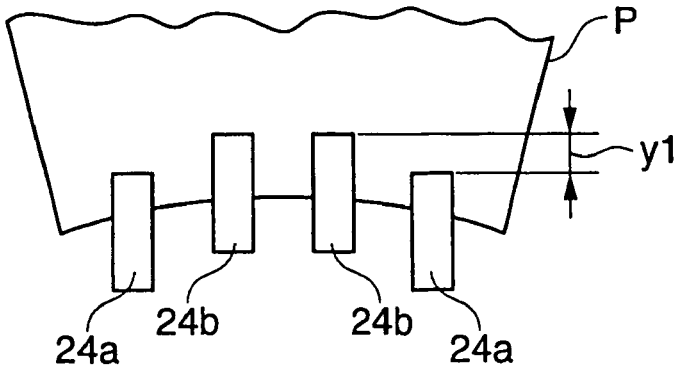
FIG. 8C is a view seen from the direction of an arrow VIIIC of FIG. 8A to explain a state wherein the two ends of a sheet at the second position are pulled.

In this structure, when the trailing edge of a paper sheet P is transferred to the gripper devices 25A at the first position from an impression cylinder 7B of a second-color printing unit 3B on the upstream side in the sheet convey direction, grippers 24*a* and 24*b* of the gripper devices 25A grip the paper sheet P such that the distal ends of the grippers 24*a* and 24*b* are aligned on one straight line L2, as shown in FIG. 8B. Subsequently, when the gripper devices 25A are converted to move to the second position, the distal ends of the pair of grippers 24*a*, which are located at the two ends in the axial direction of the gripper pad shaft 17A, line up to be shifted by a length y1 in the sheet convey direction, as shown in FIG. 8C, with respect to the distal ends of the grippers 24*b* which are located at the intermediate portion in the axial direction of the gripper pad shaft 17A. This is because the rotating shaft axis C2 at the intermediate portion in the axial direction of the gripper pad shaft 17A are eccentric by the length y1 in the direction of the grippers of the gripper devices 25A located at the first position.

The pair of grippers 24*a* located at the two ends in the widthwise direction of the paper sheet P pull the two ends of the trailing edge of the paper sheet P in the widthwise direction of the paper sheet P. Thus, that edge (the leading edge) of the paper sheet P which is not gripped by the gripper devices 25A becomes taut. Even when the leading edge of the paper sheet P which is not gripped by the gripper devices 25A is stretched in the widthwise direction of the paper sheet P, the leading edge of the paper sheet P becomes taut before the paper sheet P is transferred to gripper devices 25B, to correct this phenomenon. Therefore, the fan-out register accuracy can be improved.

Figure 9:
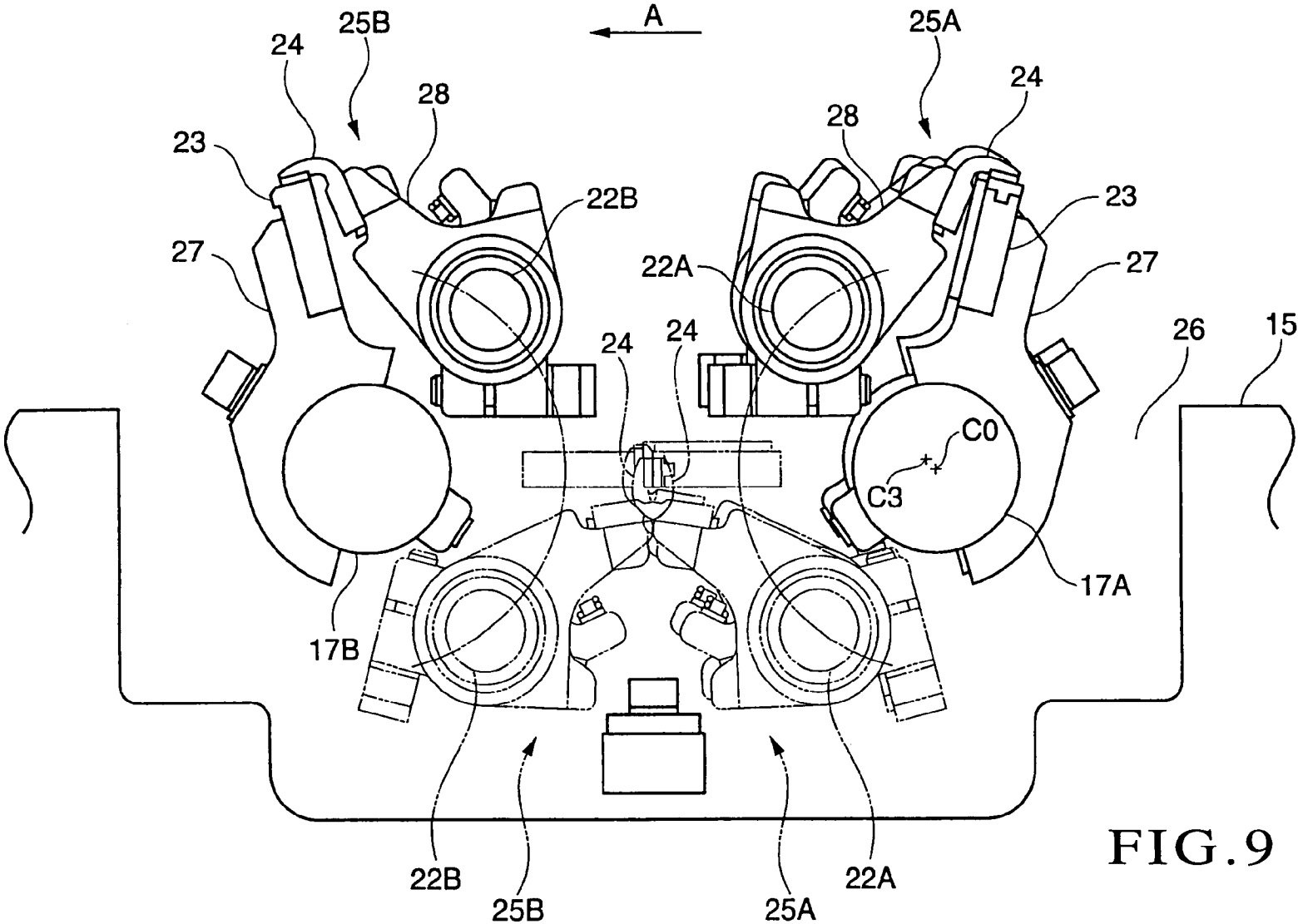
FIG. 9 is a sectional view taken along the line III-III of FIG. 2B to show the third embodiment of the present invention.
Figure 10:
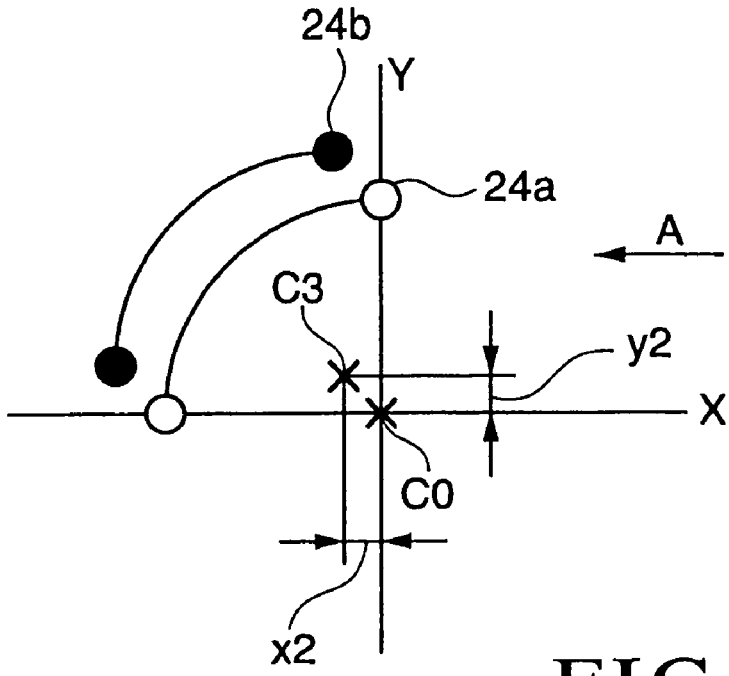
FIG. 10 is a view showing a state wherein the rotating shaft axis at the intermediate portion in the axial direction of the gripper pad shaft shown in FIG. 9 is eccentric with respect to the rotating shaft axes at the two ends of the gripper pad shaft in a direction of an arrow A (a sheet convey direction) and a direction perpendicular to the direction of the arrow A, and the trajectory from the first position (upright state) to the second position (lying state) of gripper members provided to the intermediate portion and two ends in the axial direction of the gripper pad shaft.

The third embodiment of the present invention will be described with reference to FIGS. 9 and 10.

In the third embodiment, gripper pad shaft holders 18B to 18E, which support the intermediate portion of a gripper pad shaft 17A are attached to be displaced in a direction of an arrow A and a direction perpendicular to the direction of the arrow A with respect to gripper pad shaft holders 18A and 18F which support the two ends of the gripper pad shaft 17A. More specifically, as shown in FIG. 10, a rotating shaft axis C3 at the intermediate portion in the axial direction of the gripper pad shaft 17A is eccentric with respect to rotating shaft axes C0 at the two ends in the axial direction of the gripper pad shaft 17A by a length x2 in the direction (the direction of the grippers of gripper devices 25A at the second position) of an arrow A and a length y2 in a direction (the direction of the grippers of the gripper devices 25A at the first position) perpendicular to the direction of the arrow A. In other words, the position of the rotating shaft axis C3 at the intermediate portion of the gripper pad shaft 17A is set within the range of an angle (90°) which is formed by a line that connects the rotating shaft axes C0 at the two ends of the gripper pad shaft 17A and the gripping positions (gripper points) of the gripper devices 25A at the first position and a line that connects the rotating shaft axes C0 at the two ends of the gripper pad shaft 17A and the gripping surfaces (gripper points) of the gripper devices 25A at the second position.

In this structure, when the gripper devices 25A which grip the trailing edge of a paper sheet P at the first position move to the second position, they pull the two ends of the trailing edge of the paper sheet P in the widthwise direction of the paper sheet P, in the same manner as in the first and second embodiments, and that edge (the leading edge) of the paper sheet P which is not gripped by the gripper devices 25A becomes taut. Even when the leading edge of the paper sheet P which is not gripped by the gripper devices 25A is stretched in the widthwise direction of the paper sheet P, the leading edge of the paper sheet P becomes taut before the paper sheet P is transferred to gripper devices 25B, to correct this phenomenon. Therefore, the fan-out register accuracy can be improved.

Figure 11:
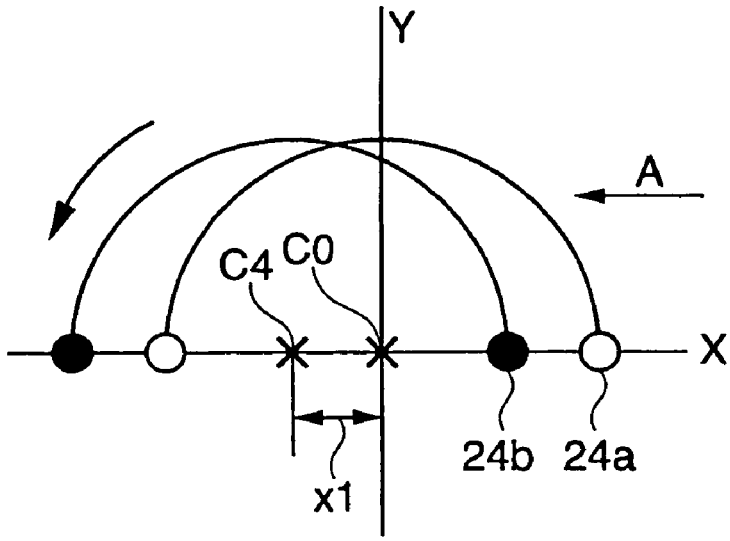
FIG. 11 is a view showing a state wherein, in the fourth embodiment of the present invention, the rotating shaft axis at the intermediate portion in the axial direction of the gripper pad shaft is eccentric with respect to the rotating shaft axes at the two ends of the gripper pad shaft in a direction of an arrow A (a sheet convey direction), and the trajectory from the first position (lying state) to the 180°-converted second position (lying state) of gripper members provided to the intermediate portion and two ends in the axial direction of the gripper pad shaft.

The fourth embodiment of the present invention will be described with reference to FIG. 11.

In the fourth embodiment, a rotating shaft axis C1 at the intermediate portion in an axial direction of a gripper pad shaft 17A is eccentric with respect to rotating shaft axes C0 at the two ends in the axial direction of the gripper pad shaft 17A by a length x1 in a direction of an arrow A (the direction of the gripping positions (gripper points) of gripper devices 25A at the second position), in the same manner as in the first embodiment. The fourth embodiment is different from the first embodiment in that after the gripper devices 25A in a lying state (first position) receive a paper sheet, they are converted through 180° in the direction of the arrow A and lie down (second position) to transfer the paper sheet. More specifically, the position of a rotating shaft axis C4 at the intermediate portion of the gripper pad shaft 17A is set within the range of an angle (about 180°) which is formed by a line that connects the rotating shaft axes C0 at the two ends of the gripper pad shaft 17A and the gripping positions (gripper points) of the gripper devices 25A at the first position and a line that connects the rotating shaft axes C0 at the two ends of the gripper pad shaft 17A and the gripping positions (gripper points) of the gripper devices 25A at the second position.

In this structure, when the gripper devices 25A which grip the trailing edge of a paper sheet P at the first position move to the second position, they pull the two ends of the trailing edge of the paper sheet P in the widthwise direction of the paper sheet P, in the same manner as in the first to third embodiments, and that edge (the leading edge) of the paper sheet P which is not gripped by the gripper devices 25A becomes taut. Even when the leading edge of the paper sheet P which is not gripped by the gripper devices 25A is stretched in the widthwise direction of the paper sheet P, the leading edge of the paper sheet P becomes taut to correct this phenomenon. Therefore, the fan-out register accuracy can be improved.

In the first embodiment, the positions of the screw holes 26*b* on the step 26*a* are shifted to make eccentric the rotating shaft axis C1 at the intermediate portion in the axial direction of the gripper pad shaft 17A. However, the present invention is not limited to this. For example, at least the insertion holes of the gripper pad shaft holders 18B to 18E may form stretched holes to shift the positions of the gripper pad shaft holders 18B to 18E. In this case, the eccentricity amount of the rotating shaft axis C1 with respect to the rotating shaft axes C0 of the gripper pad shaft 17A can be variably adjusted in an analog manner. Alternatively, the insertion holes 18*a* may be merely formed to be shifted in a direction opposite to the arrow A.

In the second embodiment, when the thickness of the spacer 51 to be interposed between the gripper pad shaft holders 18 and the step 26*a* of the notch 26 in the convertible cylinder 15 is appropriately selected, the eccentricity amount of the rotating shaft axis C2 of the gripper pad shaft 17A can be adjusted. Alternatively, no spacer may be arranged, and the heights of the gripper pad shaft holders at the intermediate portion may be differed in the direction perpendicular to the direction of the arrow A. The gripper pad shaft holders 18B and 18E arranged between the intermediate portion and two ends in the axial direction of the gripper pad shaft 17A may be coaxial with or eccentric from the axes at the two ends of the gripper pad shaft 17A.

As a mechanism that shifts the rotating shaft axis at the intermediate portion of the gripper pad shaft 17A, the gripper pad shaft 17A may be supported to have play, and screw holes may be formed in the gripper pad shaft holders 18. In this case, the distal ends of bolts to threadably engage with the screw holes may be abutted against the gripper pad shaft 17A, and the bolts may be formed forward or backward to shift the rotating shaft axis of the gripper pad shaft 17A. If the bolts are moved forward or backward by actuators such as motors, the rotating shaft axis of the gripper pad shaft 17A can be shifted automatically and not manually. A press member attached to the rod of an air cylinder may be employed in place of each bolt. One end of a press member may be merely attached to the wall surface of the notch, and the other end of the press member may press the gripper pad shaft 17A.

In the first, second, and fourth embodiments, the rotating shaft axis at the intermediate portion of the gripper pad shaft 17A is shifted in the direction of the arrow A or the direction perpendicular to the direction of the arrow A. However, the direction of shift can be different. For example, as far as the paper sheet received at the first position is stretched in the widthwise direction as it is moved to the second position, the rotating shaft axis at the intermediate portion of the gripper pad shaft 17A may be shifted from the direction of the arrow A or the direction perpendicular to the direction of the arrow A.

As has been described above, according to the present invention, even if the leading edge of the sheet is stretched in the widthwise direction, this phenomenon can be corrected before the trailing edge of the reversed sheet is transferred to the sheet holding means on the downstream side in the sheet convey direction. Therefore, the fan-out register accuracy is improved.

What is claimed is:

1. A sheet convey apparatus for a sheet-fed offset rotary printing press with a convertible mechanism, comprising:

sheet holding means for swinging between a first position to receive a sheet from a first sheet holding member on an upstream side in a sheet convey direction and a second position to transfer the sheet to a second sheet holding member on a downstream side in the sheet convey direction; and a pivotal shaft which extends in a widthwise direction of the sheet and pivots together with said sheet holding means, wherein a position of a rotating shaft axis at an intermediate portion of said pivotal shaft is set within a range of an angle which is formed by a line that connects rotating shaft axes at two ends of said pivotal shaft and a sheet holding position of said sheet holding means at the first position and a line that connects the rotating shaft axes at said two ends of said pivotal shaft and a sheet holding position of said sheet holding means at the second position, wherein said position of said rotating shaft axis at said intermediate portion of said pivotal shaft is offset with respect to a position of rotating shaft axes at two ends of said pivotal shaft, wherein, when said first sheet holding means swings between the first position and the second position, the position of the rotating shaft axis at the intermediate portion of said pivotal shaft and the position of the rotating shaft axes at two ends of said pivotal shaft do not change with regard to each other.

2. The apparatus according to claim 1, wherein the rotating shaft axis at said intermediate portion of said pivotal shaft is substantially located on the line that connects the rotating shaft axes at said two ends of said pivotal shaft and the sheet holding position of said sheet holding means at the second position.

3. The apparatus according to claim 1, wherein the rotating shaft axis at said intermediate portion of said pivotal shaft is substantially located on the line that connects the rotating shaft axes at said two ends of said pivotal shaft and the sheet holding position of said sheet holding means at the first position.

4. The apparatus according to claim 1, further comprising displacing means for supporting said pivotal shaft such that said intermediate portion of said pivotal shaft is displaced with respect to said two ends thereof, wherein the sheet which is received by said sheet holding means at the first position is stretched in the widthwise direction when said sheet holding means moves to the second position.

5. The apparatus according to claim 4, wherein said displacing means displaces said intermediate portion of said pivotal shaft in the sheet convey direction.

6. The apparatus according to claim 5, wherein said displacing means comprises a plurality of shaft holders which support said pivotal shaft such that said intermediate portion of said pivotal shaft is displaced with respect to said two ends of said pivotal shaft in the sheet convey direction.

7. The apparatus according to claim 1, further comprising a convertible cylinder which is arranged between a printing unit on the upstream side in the sheet convey direction and a printing unit on the downstream side in the sheet convey direction and has a notch in an axial direction to accommodate said sheet holding means, wherein said sheet holding means moves from the first position where said sheet holding means rises in the notch in said convertible cylinder to the second position where said sheet holding means lies in the notch in said convertible cylinder.

8. The apparatus according to claim 1, wherein said second sheet holding member swings between a first position to receive the sheet from said sheet holding means on the upstream side in the sheet convey direction and a second position to transfer the sheet to a third sheet holding member on the downstream side in the sheet convey direction, and during double-side printing, the sheet is transferred from said sheet holding means at the second position to said second sheet holding member at the first position.

9. The apparatus according to claim 8, further comprising a convertible cylinder which is arranged between a printing unit on the upstream side in the sheet convey direction and a printing unit on the downstream side in the sheet convey direction and has a notch in an axial direction to accommodate said sheet holding means and said second sheet holding member, wherein said sheet holding means and second sheet holding member are arranged adjacent to each other in the notch.

10. The apparatus according to claim 1, wherein said sheet holding means comprises a plurality of gripper pads which are supported by said pivotal shaft along the widthwise direction of the sheet and a plurality of grippers which are arranged to correspond to said gripper pads, and sheet holding positions of said sheet holding means at the first and second positions are where said sheet holding means holds the sheet between said grippers and gripper pads.

11. The apparatus according to claim 1, wherein the rotating shaft axis at the intermediate portion of said pivotal shaft is eccentric with respect to the rotating shaft axes at said two ends of said pivotal shaft by 100 μm to 500 μm.

12. A sheet convey apparatus for a sheet-fed offset rotary printing press with a convertible mechanism, comprising: sheet holding means for swinging between a first position to receive a sheet from a first sheet holding member on an upstream side in a sheet convey direction and a second position to transfer the sheet to a second sheet holding member on a downstream side in the sheet convey direction; and a pivotal shaft which extends in a widthwise direction of the sheet and pivots together with said sheet holding means, wherein a position of a rotating shaft axis at an intermediate portion of said pivotal shaft is set within a range of an angle which is formed by a line that connects rotating shaft axes at two ends of said pivotal shaft and a sheet holding position of said sheet holding means at the first position and a line that connects the rotating shaft axes at said two ends of said pivotal shaft and a sheet holding position of said sheet holding means at the second position, displacing means for supporting said pivotal shaft such that said intermediate portion of said pivotal shaft is displaced with respect to said two ends thereof, wherein the sheet which is received by said sheet holding means at the first position is stretched in the widthwise direction when said sheet holding means moves to the second position, and said displacing means displaces said intermediate portion of said pivotal shaft in a direction perpendicular to the sheet convey direction.

13. The apparatus according to claim 12, wherein said displacing means comprises a plurality of shaft holders which support said pivotal shaft such that said intermediate portion of said pivotal shaft is displaced with respect to said two ends of said pivotal shaft in the direction perpendicular to the sheet convey direction.

14. The apparatus according to claim 12, wherein said displacing means displaces said intermediate portion of said pivotal shaft in the sheet convey direction and the direction perpendicular to the sheet convey direction.

15. The apparatus according to claim 14, wherein said displacing means comprises a plurality of shaft holders which support said pivotal shaft such that said intermediate portion of said pivotal shaft is displaced with respect to said two ends of said pivotal shaft in the sheet convey direction and the direction perpendicular to the sheet convey direction.

16. The apparatus according to claim 12, further comprising a convertible cylinder which is arranged between a printing unit on the upstream side in the sheet convey direction and a printing unit on the downstream side in the sheet convey direction and has a notch in an axial direction to accommodate said sheet holding means, wherein said displacing means comprises a plurality of shaft holders which are fixed in the notch of said convertible cylinder to be aligned in the axial direction of said convertible cylinder and holds said pivotal shaft, said shaft holders which hold said intermediate portion of said pivotal shaft being fixed in the notch of said convertible cylinder to be shifted from corresponding ones of said shaft holders which hold said two ends of said pivotal shaft at least in one of the sheet convey direction and the direction perpendicular to the sheet convey direction.

17. The apparatus according to claim 16, wherein said displacing means further comprises a plurality of screw holes which are formed in the notch of said convertible cylinder to correspond to said shaft holders, a plurality of through holes which are formed in said shaft holders, and a plurality of bolts, in the plurality of screw holes, which fix said shaft holder that holds said intermediate portion of said pivotal shaft to be shifted in the sheet convey direction from said shaft holders that hold said two ends of said pivotal shaft.

18. The apparatus according to claim 16, wherein said displacing means further comprises a plurality of spacers which are interposed between an attaching surface in the notch of said convertible cylinder and said shaft holders that hold said intermediate portion of said pivotal shaft, and when said spacers are interposed, said shaft holders that hold said intermediate portion of said pivotal shaft are fixed to be shifted in the direction perpendicular to the sheet convey direction.

19. A sheet convey apparatus for a sheet-fed offset rotary printing press, including a first sheet holding means which swings between a first position to receive a sheet from a first sheet holding member on an upstream side in a sheet convey direction and a second position to transfer the sheet with respect to the first position to a second sheet holding means on a downstream side in the sheet convey direction, said first sheet holding means being swingably arranged on a pivotal shaft which extends in a widthwise direction of the sheet to be conveyed, wherein a position of a rotating shaft axis at an intermediate portion of said pivotal shaft is offset with respect to a position of rotating shaft axes at two ends of said pivotal shaft, wherein, when said first sheet holding means swings between the first position and the second position, the position of the rotating shaft axis at the intermediate portion of said pivotal shaft and the position of the rotating shaft axes at two ends of said pivotal shaft do not change from each other, and wherein the sheet which is received by said sheet holding means at the first position is stretched in the widthwise direction by the movement of said first sheet holding means to the second position.

* * * * *